US010155305B2

(12) United States Patent
Tzeng et al.

(10) Patent No.: US 10,155,305 B2
(45) Date of Patent: Dec. 18, 2018

(54) MULTI-FUNCTION MULTI-ANGLE CLEANING TOOL

(71) Applicant: Taiwan Semiconductor Manufacturing Co., Ltd., Hsin-Chu (TW)

(72) Inventors: Huan-Lisng Tzeng, Hsinchu (TW); Chia-Chi Chung, Hsinchu (TW); Kuo-Yen Chang, Zhunan Township (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 322 days.

(21) Appl. No.: 15/088,260

(22) Filed: Apr. 1, 2016

(65) Prior Publication Data

US 2017/0282347 A1 Oct. 5, 2017

(51) Int. Cl.

| | |
|---|---|
| ***B25G 1/04*** | (2006.01) |
| ***B25G 3/36*** | (2006.01) |
| ***B25G 1/00*** | (2006.01) |
| ***B08B 1/00*** | (2006.01) |
| ***B08B 3/02*** | (2006.01) |
| ***B08B 13/00*** | (2006.01) |
| ***B08B 5/02*** | (2006.01) |

(52) U.S. Cl.

CPC ..... *B25G 1/04* (2013.01); *B08B 1/00* (2013.01); *B08B 1/002* (2013.01); *B08B 1/005* (2013.01); *B08B 3/026* (2013.01); *B08B 5/02* (2013.01); *B25G 1/005* (2013.01); *B25G 3/36* (2013.01); *B08B 13/00* (2013.01)

(58) Field of Classification Search

CPC ..... B08B 13/00; B08B 1/00; B08B 1/002; B08B 1/005; B08B 3/026; B08B 5/02; B25G 1/005; B25G 1/04; B25G 3/36

See application file for complete search history.

(56) References Cited

U.S. PATENT DOCUMENTS

| | | | | |
|---|---|---|---|---|
| 1,268,734 A * | 6/1918 | Lay | A46B 5/0083 | 403/290 |
| 2,555,226 A * | 5/1951 | Draughn | B25G 3/38 | 15/144.1 |
| 5,123,768 A * | 6/1992 | Franklin | A46B 5/0075 | 403/84 |
| 5,810,408 A * | 9/1998 | Armstrong | A01B 1/00 | 16/422 |
| 6,199,245 B1 * | 3/2001 | Blessing | B25G 1/06 | 16/422 |
| 6,925,676 B2 * | 8/2005 | Heavner | E04D 13/0765 | 15/236.04 |
| 7,770,252 B2 * | 8/2010 | Errichiello | A46B 5/0075 | 15/144.1 |

(Continued)

*Primary Examiner* — Marc Carlson

(74) *Attorney, Agent, or Firm* — Eschweiler & Potashnik, LLC

(57) ABSTRACT

In some embodiments, a maintenance apparatus is provided for maintaining semiconductor processing equipment. The maintenance apparatus has an articulated member having a first member with a handle engagement portion and a second member with a first tool engagement portion. The first member is rotationally coupled to the first member about an articulation axis. A first tool member in selective engagement with the first tool engagement portion of the second member.

20 Claims, 9 Drawing Sheets

(56) References Cited

U.S. PATENT DOCUMENTS

| | | | | |
|---|---|---|---|---|
| 9,440,622 | B2 * | 9/2016 | Hagans | B25G 1/06 |
| 2005/0134064 | A1 * | 6/2005 | Nies | A01B 1/222 294/51 |
| 2006/0016047 | A1 * | 1/2006 | Blackman | B25G 1/04 16/231 |
| 2011/0271488 | A1 * | 11/2011 | Swinderman | B25G 1/04 16/421 |
| 2015/0007404 | A1 * | 1/2015 | Prosser | B25G 3/38 15/144.1 |
| 2016/0159146 | A1 * | 6/2016 | Ramirez, Jr. | B60B 29/003 81/177.2 |
| 2017/0036237 | A1 * | 2/2017 | Warner | B05C 17/0227 |

* cited by examiner

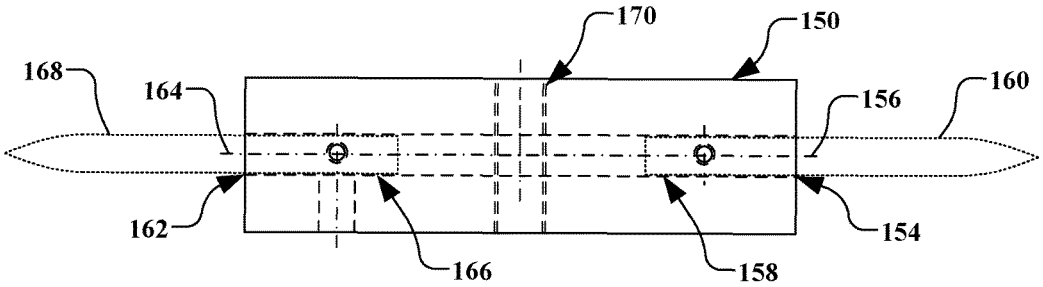
Fig. 6A
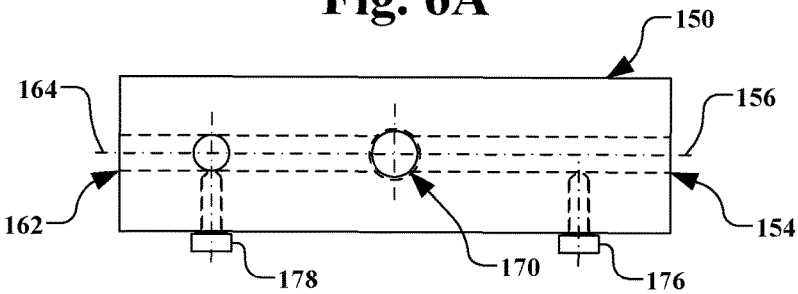
Fig. 6B
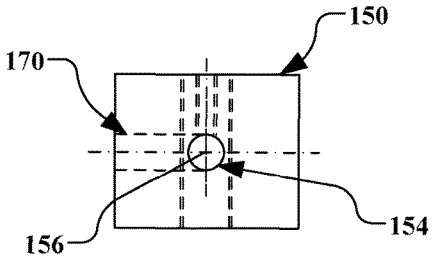
Fig. 6C
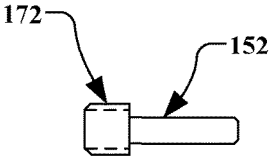
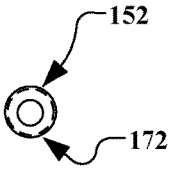
Fig. 7A Fig. 7B

MULTI-FUNCTION MULTI-ANGLE CLEANING TOOL

BACKGROUND

In semiconductor manufacturing, cleaning and maintenance of semiconductor processing equipment is conventionally performed to maintain peak operating conditions of said equipment. Some equipment can be difficult to clean or maintain unless disassembled or otherwise modified to gain access to various locations within the equipment. Tools used for cleaning and maintaining such equipment is often specific to particular components, as many components have architectures that prevent access by generic cleaning tools, or if access is possible, the generic cleaning tools do not adequately perform the desired cleaning function.

BRIEF DESCRIPTION OF THE DRAWINGS

FIGS. 6A, 6B, and 6C illustrate respective top, front, and side views of some embodiments of an extension member of a maintenance apparatus according to an example of the present disclosure.

FIGS. 7A-7B illustrate respective front and side views of an engagement of some embodiments of a maintenance apparatus according to an example of the present disclosure.

DETAILED DESCRIPTION

Figure 1:
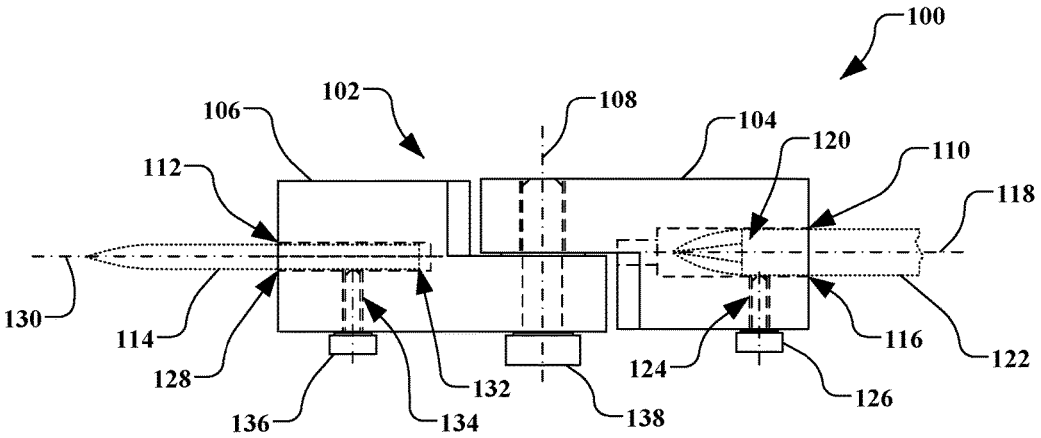
FIG. 1 illustrates some embodiments of a maintenance apparatus according to an example of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Semiconductor chips are formed by operating upon a semiconductor substrate (e.g., a silicon wafer) with a plurality of different processing steps that transform the semiconductor substrate into an integrated chip. The plurality of different processing steps often form one or more semiconductor devices (e.g., transistor devices) within the semiconductor substrate and a plurality of metal interconnect layers within a dielectric structure overlying the semiconductor substrate. The processing steps may comprise deposition processes, etching processes, patterning processes, etc., for example.

Some processing steps may cause waste byproducts to accumulate within a processing tool (e.g., a processing chamber) in which the processing step is performed. For example, a deposition process may result in a waste byproduct accumulating onto interior surfaces of a processing chamber in which the deposition process is performed. The accumulation of the waste byproduct can cause numerous problems including the contamination of integrated chips that can decrease yield. Therefore, the processing tools are periodically cleaned to remove accumulated waste byproduct from the processing tools. However, it has been appreciated that many processing tools comprise confined spaces that are difficult to reach with conventional cleaning tools. For example, turbo vacuum pumps, which are configured to evacuate waste from a processing chamber, are often coupled to the processing chamber by way of an exhaust conduit coupled to a small exit aperture having a confined space that is difficult to clean. The difficulty of cleaning such small spaces causes conventional cleaning tools to provide for poor cleaning and/or long and costly cleaning times.

The present disclosure relates to a maintenance apparatus for maintaining semiconductor processing equipment, which is configured to provide for good cleaning within a confined area, and an associated method of operation. In some embodiments, the maintenance apparatus comprises an articulated member comprising a first member having a handle engagement portion, and a second member having a first tool engagement portion. The first member is rotationally coupled to the first member about an articulation axis. A first tool member is in selective engagement with the first tool engagement portion of the second member. The coupling between the first member and the second member allows for the maintenance apparatus to operate as a multi-angle cleaning tool that can provide for good cleaning within a confined area.

Referring now to the Figures, FIG. 1 illustrates some embodiments of a maintenance apparatus 100 for cleaning and/or maintaining equipment in accordance with several examples of the present disclosure. For example, the maintenance apparatus 100 may be utilized in cleaning (e.g., removing effluent by-products resulting from processes) and/or maintaining various semiconductor equipment or systems, such as vacuum systems, ETC tools MXP/Super-e in TV housings, and various apparatus having confined spaces. The maintenance apparatus 100 provides for improved cleaning of confined spaces that are difficult to reach with conventional cleaning tools, thereby improving cleaning and/or reducing cleaning times.

The maintenance apparatus 100, for example, comprises an articulated member 102, wherein the articulated member comprises a first member 104 and a second member 106. The first member is rotationally coupled to the second member about an articulation axis 108 that extends through the first member 104 and the second member 106. In various embodiments, the first member 104 and a second member 106 may comprise a metal. For example, the first member 104 and the second member 106 may comprise aluminum, steel, or some other metallic material. In various other embodiments, the first member 104 and the second member 106 may comprise other materials, such as a plastic, for example.

The first member 104, for example, comprises a handle engagement portion 110, and the second member 106 comprises a first tool engagement portion 112. The second member 106 is configured to selectively engage a first tool member 114 via the first tool engagement portion 112. For example, in some embodiments, the second member 106 may be configured to engage a first tool member 114 comprising a tool configured to physically remove unwanted waste byproduct by physical scraping (e.g., a pick or a brush). In other embodiments, the second member 106 may be configured to engage a first tool member 114 comprising other cleaning tools (e.g., an air gun, a fluid pick, etc.).

The rotational coupling between the first member 104 and the second member 106 allows for the engaged first tool member 114 to effectively clean confined spaces within a processing chamber at multiple angles, thereby improving cleaning efficiency and quality.

Figure 2A:
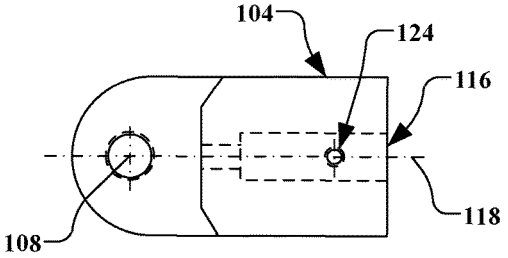
FIGS. 2A, 2B, and 2C illustrate respective top, front, and side views of some embodiments of a first member of a maintenance apparatus according to an example of the present disclosure.
Figure 2B:
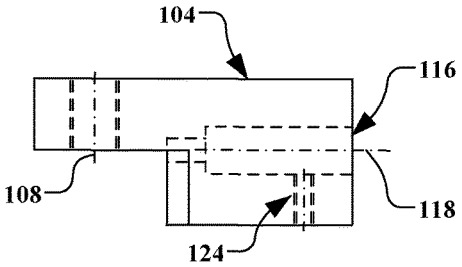
Figure 2C:
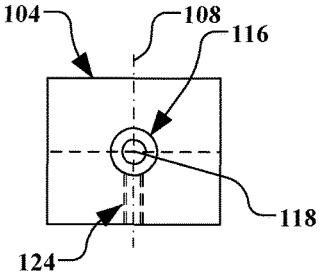

In one example, some embodiments of the first member 104 is illustrated in FIGS. 2A-2C, wherein the handle engagement portion 110 comprises a handle engagement hole 116 defined in the first member. The handle engagement hole 116, for example, has a handle engagement axis 118 associated therewith, wherein the handle engagement axis is generally perpendicular to the articulation axis 108. The handle engagement hole 116, for example, is further configured to accept a distal end 120 of a handle member 122 therein, as illustrated in FIG. 1.

The handle engagement portion 110 of the first member 104, in one example, further comprises a threaded handle fastening hole 124 and a threaded handle fastener 126 (e.g., a screw), wherein the threaded handle fastening hole intersects the handle engagement hole 116, and wherein the threaded handle fastener is configured to threadingly engage the threaded handle fastener hole and selectively intersect the handle engagement hole. The threaded handle fastener 126, for example, is configured to selectively secure the distal end 120 of the handle member 122 to the first member 104, such as via a rotation of the threaded handle fastener with respect to the first member. It should be noted that the threaded handle fastener 126 may alternatively comprise any fastener operable to selectively secure the distal end 120 of the handle member 122 to the first member 104, and any such alternatives are contemplated as falling within the scope of the present disclosure.

Figure 3A:
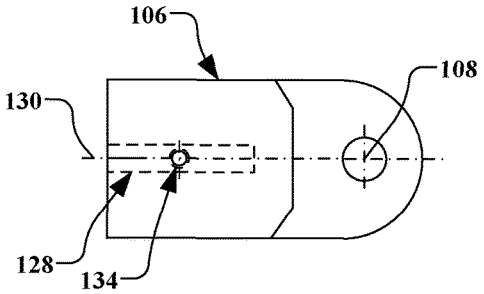
FIGS. 3A, 3B, and 3C illustrate respective top, front, and side views of some embodiments of a second member of a maintenance apparatus according to an example of the present disclosure.
Figure 3B:
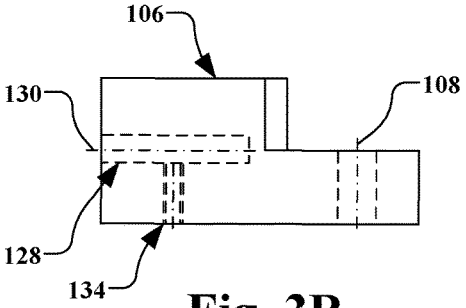
Figure 3C:
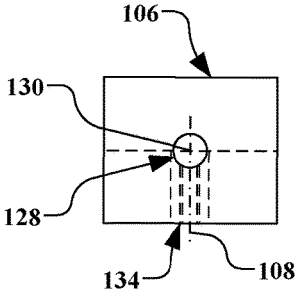
Figure 4A:
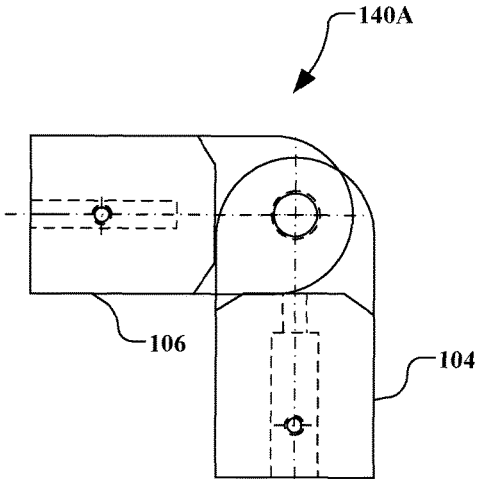
FIGS. 4A-4D illustrate some embodiments of various orientations of a second member of a maintenance apparatus with respect to a first member thereof according to an example of the present disclosure.
Figure 4B:
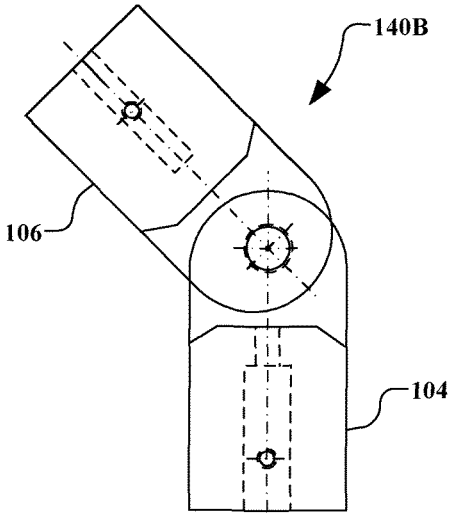
Figure 4C:
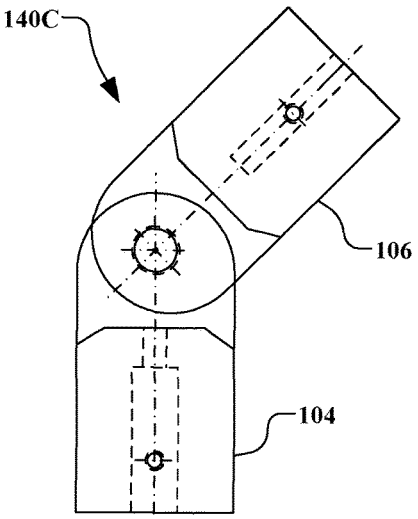
Figure 4D:
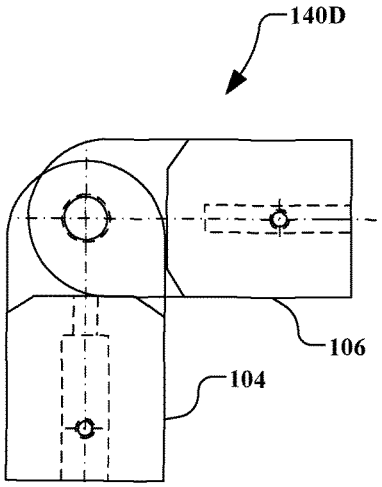

In accordance with another example of the present disclosure, the first tool engagement portion 112 of the second member 106 comprises a first tool engagement hole 128 defined in the second member, as illustrated in greater detail in FIGS. 3A-3C. The first tool engagement hole 128, for example, has a first tool engagement axis 130 associated therewith, wherein the first tool engagement axis is generally perpendicular to the articulation axis 108. The first tool engagement hole 128, for example, is configured to accept a distal end 132 of the first tool member 114 therein, as illustrated in FIG. 1.

The first tool engagement portion 112 of the second member 106, for example, further comprises a first threaded tool fastening hole 134 and a first threaded tool fastener 136, wherein the first threaded tool fastening hole intersects the first tool engagement hole 128. The first threaded tool fastener 136, for example, is configured to threadingly engage the first threaded tool fastener hole 134 and selectively intersect the first tool engagement hole 128, therein selectively securing the distal end 132 of the first tool member 114 to the second member 106. In some embodiments, the first threaded tool fastener hole 134 is substantially perpendicular to the first tool engagement hole 128.

According to another example, the first member 104 is rotationally coupled to the second member 106 via an articulation member 138 (e.g., a screw), wherein the articulation member is operably coupled the first member and second member to provide rotation of the first member with respect to the second member about the articulation axis 108. It should be noted that while the articulation member 138 may comprise any member operable to rotationally couple the first member 104 to the second member 106, and may comprise a screw, pin, or any other joint operable to provide such rotation.

For example, as illustrated in FIG. 4A-4D, the maintenance apparatus 100 is shown in various respective positions 140A-140D, whereby the second member 106 is rotated with respect to the first member 104. While four positions 140A-140D are illustrated in the present example, it will be understood that any rotational orientation of the second member 106 rotated with respect to the first member 104 is contemplated as falling within the scope of the present disclosure. By providing such a rotation of the second member 106 with respect to the first member 104 (or vice-versa), the maintenance apparatus 100 advantageously provides dexterity for the first tool member 114 of FIG. 1 to clean and/or maintain locations in various equipment that heretofore has not been possible using conventional cleaning tools.

Figure 5:
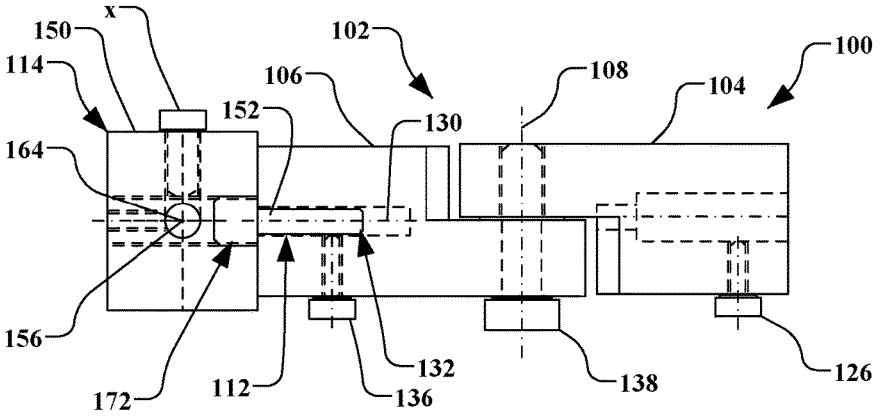
FIG. 5 illustrates some embodiments of maintenance apparatus having an extension member according to an example of the present disclosure.

In accordance with another exemplary aspect of the disclosure, the first tool member 114 comprises an extension member 150 and an engagement pin 152, as illustrated in FIG. 5. The engagement pin 152, for example, is in selective engagement with the first tool engagement portion 112 of the second member 106, therein selectively operably coupling the extension member 150 to the second member. For example, as further illustrated in FIGS. 6A-6C, the extension member 150 comprises a second tool engagement hole 154 defined therein, wherein the second tool engagement hole has a second tool engagement axis 156 associated therewith. The second tool engagement axis 156, for example, is offset from the first tool engagement axis 130 of FIG. 5, for example, wherein the second tool engagement hole 154 of the extension member 150 is configured to accept a distal end 158 of a second tool member 160 therein, as illustrated in FIG. 6A. In the present example, the second tool engagement axis 156 is generally perpendicular to the first tool engagement axis 130 of FIG. 5, but any angular offset of the second tool engagement axis from the first tool engagement axis is contemplated as falling within the scope of the present disclosure.

According to another example, the extension member 150 further comprises a third tool engagement hole 162 defined therein, wherein the third tool engagement hole has a third tool engagement axis 164 associated therewith. In the present example, the third tool engagement axis 164 is offset from the first tool engagement axis 130 of FIG. 5, but any angular offset of the second tool engagement axis from the first tool engagement axis is contemplated as falling within the scope of the present disclosure. Further, while present shown as being coaxial, the second tool engagement axis 156 and third tool engagement hole 162 of FIGS. 6A-6C may be offset from one another by any angle or distance. The third tool engagement hole 162 of the extension member 150, for example, is configured to accept a distal end 166 of a third tool member 168 therein, as illustrated in FIG. 6A.

In accordance with another example, as illustrated in FIGS. 6A-6C, the extension member 150 comprises an engagement hole 170 (e.g., a threaded hole). As illustrated in FIGS. 7A-7B, the engagement pin 152 comprises a threaded portion 172 configured to threadingly engage the engagement hole 170 of FIG. 6A-6C, while a distal end 174 of the engagement pin generally defines the distal end 132 of the first tool member 114 of FIG. 5. Further, the extension member 150 is configured to secure one or more of the second tool member 160 and the third tool member 168 via a respective second threaded tool fastener 176 and third threaded tool fastener 178 illustrated in FIG. 6B.

Figure 8:
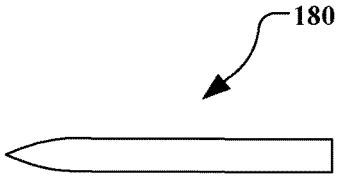
FIG. 8 illustrates some embodiments of a pick according to an example of the present disclosure.
Figure 9:
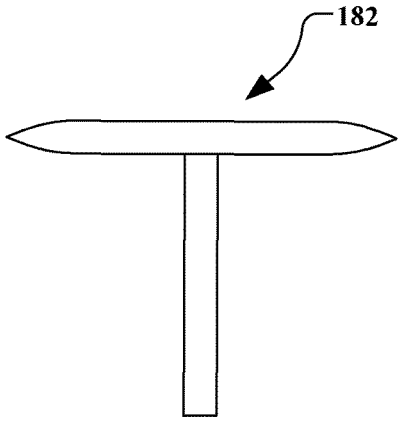
FIG. 9 illustrates some embodiments of a double-ended according to an example of the present disclosure.
Figure 10:
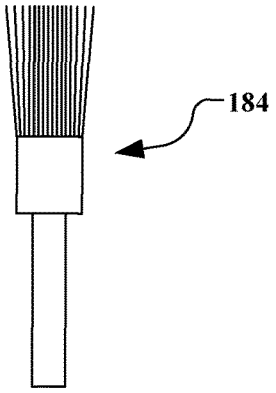
FIG. 10 illustrates some embodiments of a course brush according to an example of the present disclosure.
Figure 11A:
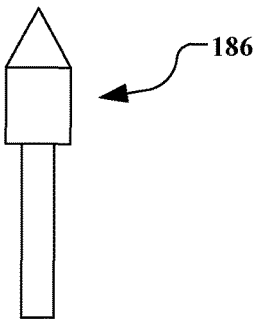
FIGS. 11A-11B illustrates respective front and side views of some embodiments of a blunt pick according to an example of the present disclosure.
Figure 11B:
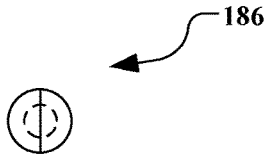
Figure 12A:
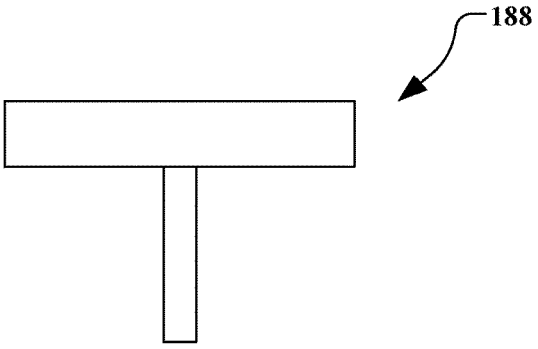
FIGS. 12A-12B illustrates respective front and side views of some embodiments of a plastic block scraper according to an example of the present disclosure.
Figure 12B:
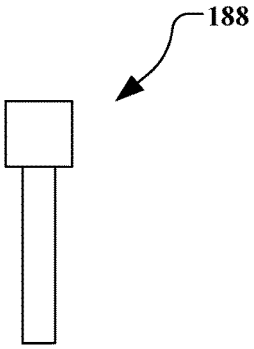
Figure 13A:
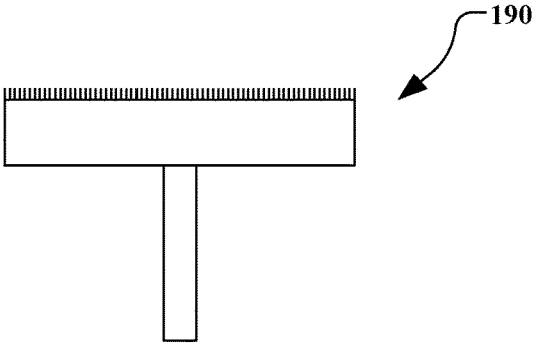
FIGS. 13A-13B illustrates respective front and side views of some embodiments of a fine brush according to an example of the present disclosure.
Figure 13B:
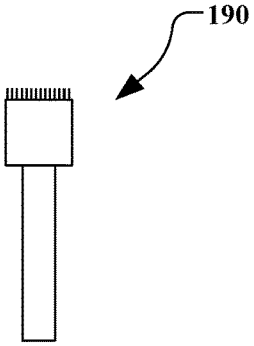
Figure 14A:
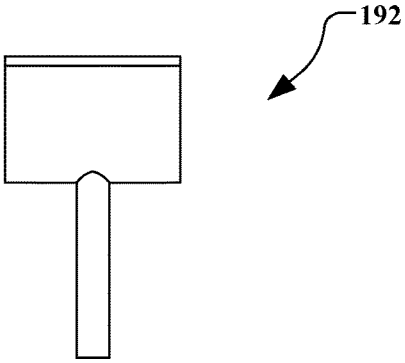
FIGS. 14A-14B illustrates respective front and side views of some embodiments of a scraper according to an example of the present disclosure.
Figure 14B:
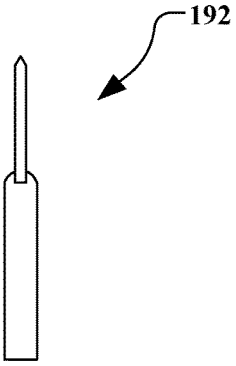
Figure 15:
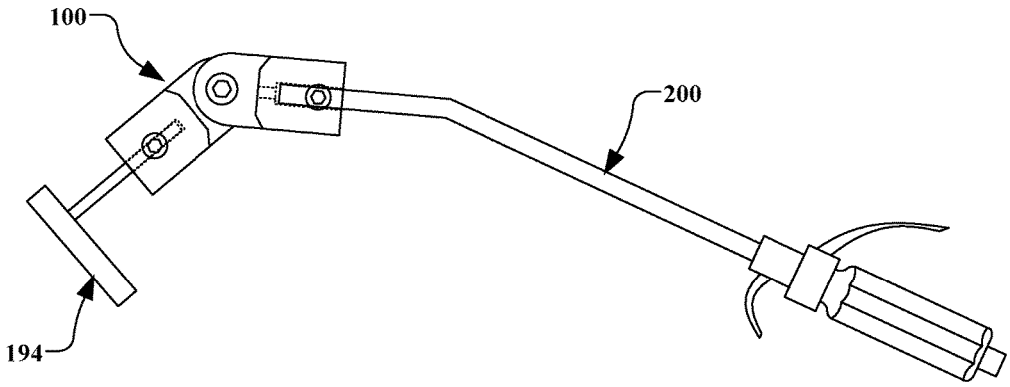
FIG. 15 illustrates some embodiments of a maintenance apparatus coupled to a blow-off device according to an example of the present disclosure.
Figure 16:
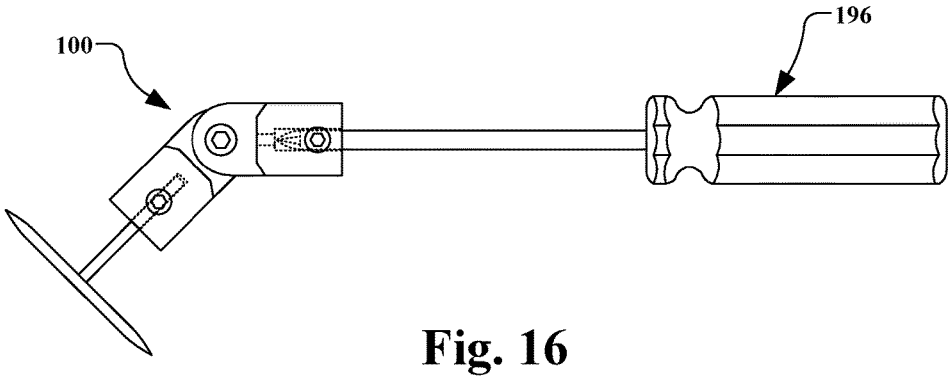
FIG. 16 illustrates some embodiments of a maintenance apparatus coupled to a screwdriver according to an example of the present disclosure.

In accordance with another aspect of the disclosure, one or more of the first tool member 114, second tool member 160, and third tool member 168 comprises one of a pick 180 illustrated in FIG. 8, a double-ended pick 182 illustrated in FIG. 9, a course brush 184 illustrated in FIG. 10, a blunt pick 186 illustrated in FIGS. 11A-11B, a plastic block scraper 188 illustrated in FIGS. 12A-12B, a fine brush 190 illustrated in FIGS. 13A-13B, scraper 192 illustrated in FIGS. 14A-14B, and a nozzle 194 illustrated in FIG. 15.

Figure 17:
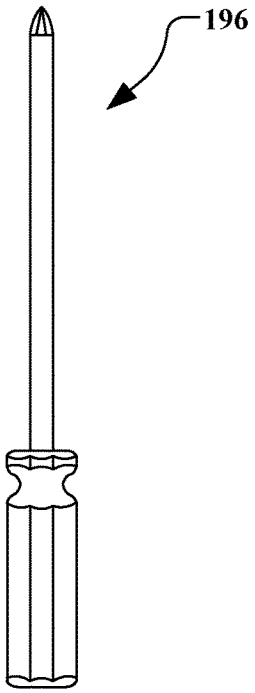
FIG. 17 illustrates some embodiments of a screwdriver according to an example of the present disclosure.
Figure 18:
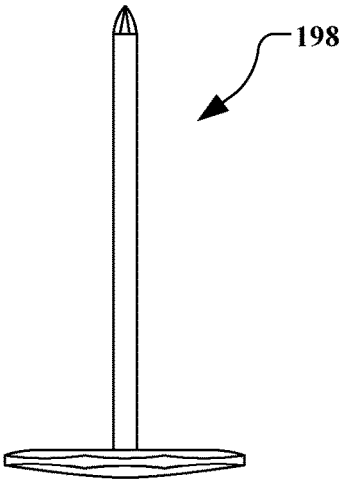
FIG. 18 illustrates some embodiments of a T-handle device according to an example of the present disclosure.
Figure 19:
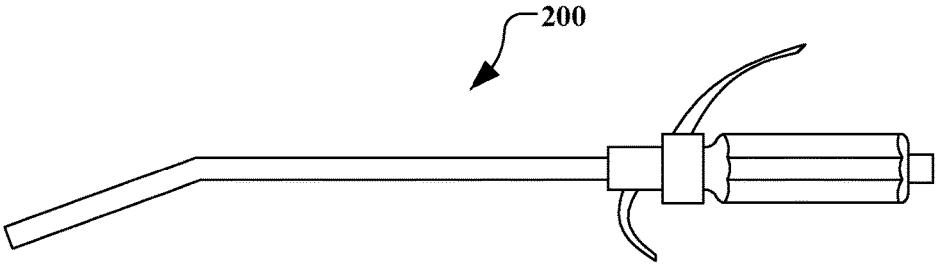
FIG. 19 illustrates some embodiments of a blow-off device according to an example of the present disclosure.

In various embodiments, the handle member 122 of FIG. 1 may comprise a variety of different devices. FIGS. 17-19 illustrate some non-limiting examples of such devices. It will be appreciated that the devices shown in FIGS. 17-19 are non-limiting examples and that other device may also be operable to connect to the handle engagement portion 110 of the maintenance apparatus 100 of FIG. 1.

FIG. 17 illustrates some embodiments of a handle member 122 comprising a screwdriver 196. In some embodiments, the screwdriver 196 may have head arranged onto a shaft. In various embodiments, the head may have a flattened tip, a cross-shaped tip, a star-shaped tip, of a tip having other shapes. In some embodiments, the screw driver 196 may be used in conjunction with a first tool member 114 comprising a scraping tool (e.g., a pick or a brush).

FIG. 18 illustrates some embodiments of a handle member 122 comprising a T-handle device 198. In some embodiments, the T-handle device 198 device comprises a 'T' shaped device having a head connected to a first end of a shaft. The shaft extends in a first direction and has a second end that contacts a base that extends in a second direction perpendicular to the first direction. In some embodiments, the T-handle device 198 may be used in conjunction with a first tool member 114 comprising a scraping tool (e.g., a pick or a brush).

FIG. 19 illustrates some embodiments of a handle member 122 comprising a blow-off device 200. The blow-off device 200 is configured to provide a stream of fluid (e.g., air, water, cleaning solution, etc.) to a first tool member 114 that is configured to clean a processing chamber with the fluid.

Figure 20:
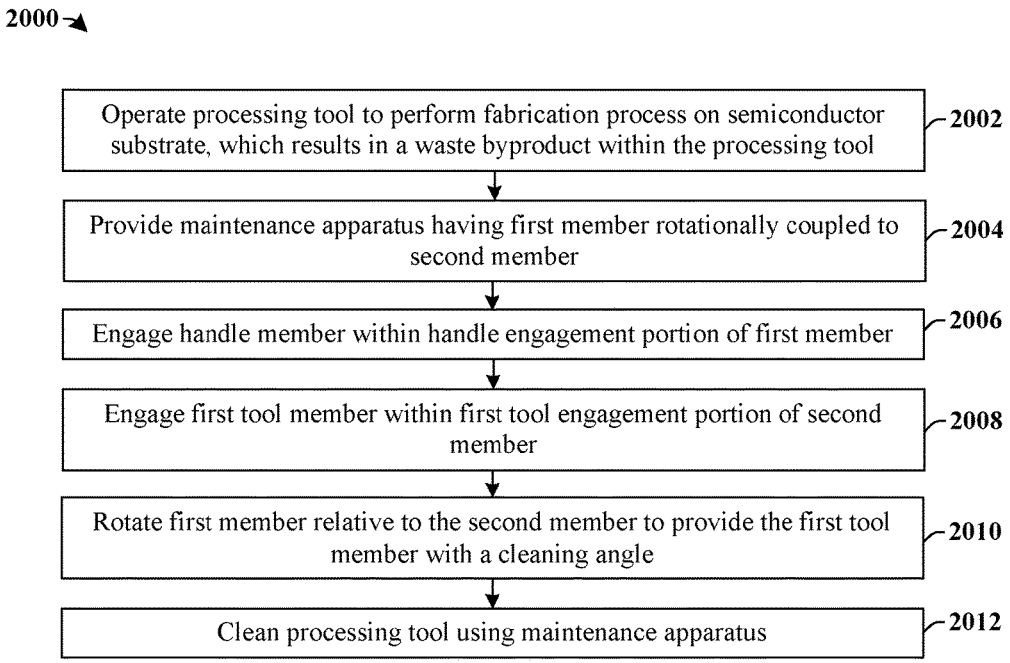
FIG. 20 illustrates a flow diagram of some embodiments of a method 2000 of cleaning a confined space within a processing tool.

FIG. 20 illustrates a flow diagram of some embodiments of a method 2000 of cleaning a confined space within a processing tool. In some embodiments, the confined space may comprise an exhaust conduit for a turbo vacuum pump. In other embodiments, the confined space may comprise other spaces within a processing tool.

While the disclosed method 2000 is illustrated and described herein as a series of acts or events, it will be appreciated that the illustrated ordering of such acts or events are not to be interpreted in a limiting sense. For example, some acts may occur in different orders and/or concurrently with other acts or events apart from those illustrated and/or described herein. In addition, not all illustrated acts may be required to implement one or more aspects or embodiments of the description herein. Further, one or more of the acts depicted herein may be carried out in one or more separate acts and/or phases.

At 2002, a processing tool is operated to perform a fabrication process on a semiconductor substrate, wherein the fabrication process results in a waste byproduct within the processing tool. In various embodiments, the fabrication process may comprise a deposition process (e.g., a CVD process, a PVD process, a spin coating process, etc.), an etching process, or a patterning processes, for example.

At 2004, a maintenance apparatus is provided having a first member rotationally coupled to a second member by way of an articulation axis.

At 2006, a handle member is engaged within a handle engagement portion of a first member of the maintenance apparatus. In some embodiments, the handle engagement portion may comprise a first recess within the first member.

At 2008, a first tool member is engaged within a first tool engagement portion of the second member of the maintenance apparatus. In some embodiments, the first tool engagement portion may comprise a second recess within the first member.

At 2010, the first member is rotated relative to the second member to provide the first tool member with a cleaning angle. In some embodiments, act 2010 may be repeated multiple times to provide the maintenance apparatus with multiple angles.

At 2012, the processing tool is cleaned using the maintenance apparatus.

Accordingly, a maintenance apparatus is provided for advantageously maintaining semiconductor processing equipment, wherein the apparatus comprises an articulated member. The articulated member comprises a first member having a handle engagement portion and a second member having a first tool engagement portion, wherein the first member is rotationally coupled to the first member about an articulation axis. Further, a first tool member in selective engagement with the first tool engagement portion of the second member.

The first member may have a handle engagement portion comprising a handle engagement hole defined in the first member, wherein the handle engagement hole is configured to accept a distal end of a handle member therein. The second member may a first tool engagement portion comprising a first tool engagement hole defined in the second member, the first tool engagement hole having a first tool engagement axis associated therewith, wherein the first member is rotationally coupled to the first member about an articulation axis, wherein the first tool engagement axis is generally perpendicular to the articulation axis. The first tool engagement hole may be configured to selectively engage a distal end of the first tool member therein.

The first tool member may comprise an extension member and an engagement pin, wherein the engagement pin is in selective engagement with the first tool engagement portion of the second member, therein selectively operably coupling the extension member to the second member, and wherein the extension member comprises a second tool engagement hole defined therein, wherein the second tool engagement hole has a second tool engagement axis associated therewith, wherein the second tool engagement axis is offset from the first tool engagement axis, and wherein the second tool engagement hole of the extension member is configured to accept a distal end of a second tool member therein.

The first member may have a threaded handle fastener, wherein the handle engagement hole is configured to accept a distal end of a handle member therein, and wherein the threaded handle fastening hole intersects the handle engagement hole, wherein the threaded handle fastener is configured to threadingly engage the threaded handle fastener hole and selectively intersect the handle engagement hole, therein selectively securing the distal end of the handle member to the first member.

The second member may have a first threaded tool fastening hole and a first threaded tool fastener, wherein the first threaded tool fastening hole intersects the first tool engagement hole, wherein the first member is rotationally coupled to the first member about an articulation axis. The first tool engagement hole may be configured to selectively engage a distal end of the first tool member therein, wherein the first threaded tool fastener is configured to threadingly engage the first threaded tool fastener hole and selectively intersect the first tool engagement hole, therein selectively securing the distal end of the first tool member to the second member.

Although the present embodiments and their advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

It will be appreciated that while reference is made throughout this document to exemplary structures in discussing aspects of methodologies described herein, that those methodologies are not to be limited by the corresponding structures presented. Rather, the methodologies (and structures) are to be considered independent of one another and able to stand alone and be practiced without regard to any of the particular aspects depicted in the Figs.

Also, equivalent alterations and/or modifications may occur to those skilled in the art based upon a reading and/or understanding of the specification and annexed drawings. The disclosure herein includes all such modifications and alterations and is generally not intended to be limited thereby. In addition, while a particular feature or aspect may have been disclosed with respect to only one of several implementations, such feature or aspect may be combined with one or more other features and/or aspects of other implementations as may be desired. Furthermore, to the extent that the terms "includes", "having", "has", "with", and/or variants thereof are used herein, such terms are intended to be inclusive in meaning—like "comprising." Also, "exemplary" is merely meant to mean an example, rather than the best. It is also to be appreciated that features, layers and/or elements depicted herein are illustrated with particular dimensions and/or orientations relative to one another for purposes of simplicity and ease of understanding, and that the actual dimensions and/or orientations may differ substantially from that illustrated herein.

What is claimed is:

1. A maintenance apparatus for maintaining semiconductor processing equipment, the maintenance apparatus comprising:

a handle member comprising a blow-off device;

an articulated member comprising:

a first member having a handle engagement portion configured to selectively engage the handle member, wherein the handle member is configured to provide a stream of fluid to at least the first member; and a second member having a first tool engagement portion, wherein the first member is rotationally coupled to the second member about an articulation axis; and a first tool member in selective engagement with the first tool engagement portion of the second member.

2. The maintenance apparatus of claim 1, wherein the handle engagement portion comprises a handle engagement hole defined in the first member, wherein the handle engagement hole has a handle engagement axis associated therewith, wherein the handle engagement axis is generally perpendicular to the articulation axis, and wherein the handle engagement hole is configured to accept a distal end of the handle member therein.

3. The maintenance apparatus of claim 2, wherein the handle engagement portion further comprises a threaded handle fastening hole and a threaded handle fastener, wherein the threaded handle fastening hole intersects the handle engagement hole, wherein the threaded handle fastener is configured to threadingly engage the threaded handle fastener hole and selectively intersect the handle engagement hole.

4. The maintenance apparatus of claim 3, wherein the threaded handle fastener is configured to selectively secure the distal end of the handle member to the first member.

5. The maintenance apparatus of claim 1, wherein the first tool member comprises one of a pick, a brush, a scraper, and a nozzle.

6. The maintenance apparatus of claim 1, wherein the first tool engagement portion comprises a first tool engagement hole defined in the second member, wherein the first tool engagement hole has a first tool engagement axis associated therewith, wherein the first tool engagement axis is generally perpendicular to the articulation axis, and wherein the first tool engagement hole is configured to accept a distal end of the first tool member therein.

7. The maintenance apparatus of claim 6, wherein the first tool engagement portion further comprises a first threaded tool fastening hole and a first threaded tool fastener, wherein the first threaded tool fastening hole intersects the first tool engagement hole, wherein the first threaded tool fastener is configured to threadingly engage the first threaded tool fastener hole and selectively intersect the first tool engagement hole, therein selectively securing the distal end of the first tool member to the second member.

8. The maintenance apparatus of claim 6, wherein the first tool member comprises an extension member and an engagement pin, wherein the engagement pin is in selective engagement with the first tool engagement portion of the second member, therein selectively operably coupling the extension member to the second member, and wherein the extension member comprises a second tool engagement hole defined therein, wherein the second tool engagement hole has a second tool engagement axis associated therewith, wherein the second tool engagement axis is offset from the first tool engagement axis, and wherein the second tool engagement hole of the extension member is configured to accept a distal end of a second tool member therein.

9. The maintenance apparatus of claim 8, wherein the second tool member comprises one of a pick, a brush, a scraper, and a nozzle.

10. The maintenance apparatus of claim 8, wherein the extension member further comprises a third tool engagement hole defined therein, wherein the third tool engagement hole has a third tool engagement axis associated therewith, wherein the third tool engagement axis is offset from the first tool engagement axis, and wherein the third tool engagement hole of the extension member is configured to accept a distal end of a third tool member therein.

11. The maintenance apparatus of claim 10, wherein the second tool member and third tool member are selected from a list comprising a pick, a brush, a scraper, and a nozzle.

12. The maintenance apparatus of claim 10, wherein the second tool engagement axis and third tool engagement axis are collinear.

13. The maintenance apparatus of claim 8, wherein the extension member comprises an engagement hole, wherein the engagement pin comprises a threaded portion configured to threadingly engage the engagement hole.

14. The maintenance apparatus of claim 1, wherein the first member is rotationally coupled to the second member via an articulation member operably coupled to the first member and second member.

15. The maintenance apparatus of claim 1, wherein the first tool member comprises a nozzle, wherein the blow-off device is further configured to provide the stream of fluid to at least the nozzle.

16. A maintenance apparatus for maintaining semiconductor processing equipment, the maintenance apparatus comprising:

a handle member comprising a blow-off device;

an articulated member comprising:

a first member having a handle engagement portion comprising a handle engagement hole defined in the first member, wherein the handle engagement hole is configured to accept a distal end of the handle member therein, and wherein the handle member is configured to provide a stream of fluid to at least the first member;

a second member having a first tool engagement portion comprising a first tool engagement hole defined in the second member, the first tool engagement hole having a first tool engagement axis associated therewith, wherein the first member is rotationally coupled to the second member about an articulation axis, wherein the first tool engagement axis is generally perpendicular to the articulation axis; and a first tool member, wherein the first tool engagement hole is configured to selectively engage a distal end of the first tool member therein.

17. The maintenance apparatus of claim 16, wherein the first tool member comprises an extension member and an engagement pin, wherein the engagement pin is in selective engagement with the first tool engagement portion of the second member, therein selectively operably coupling the extension member to the second member, and wherein the extension member comprises a second tool engagement hole defined therein, wherein the second tool engagement hole has a second tool engagement axis associated therewith, wherein the second tool engagement axis is offset from the first tool engagement axis, and wherein the second tool engagement hole of the extension member is configured to accept a distal end of a second tool member therein.

18. The maintenance apparatus of claim 17, wherein the second tool member and third tool member are selected from a list comprising a pick, a brush, a scraper, and a nozzle.

19. A maintenance apparatus for maintaining semiconductor processing equipment, the maintenance apparatus comprising:

an articulated member comprising:

a first member having a handle engagement portion comprising a handle engagement hole, a threaded handle fastening hole and a threaded handle fastener, wherein the handle engagement hole is configured to accept a distal end of a handle member therein, wherein the handle member comprises a blow-off device and wherein the threaded handle fastening hole intersects the handle engagement hole, wherein the threaded handle fastener is configured to threadingly engage the threaded handle fastener hole and selectively intersect the handle engagement hole, therein selectively securing the distal end of the handle member to the first member; and a second member having a first tool engagement portion comprising a first tool engagement hole, a first threaded tool fastening hole and a first threaded tool fastener, wherein the first threaded tool fastening hole intersects the first tool engagement hole, wherein the first member is rotationally coupled to the second member about an articulation axis; and a first tool member, wherein the first tool engagement hole is configured to selectively engage a distal end of the first tool member therein, wherein the first threaded tool fastener is configured to threadingly engage the first threaded tool fastener hole and selectively intersect the first tool engagement hole, therein selectively securing the distal end of the first tool member to the second member, and wherein the first tool member comprises a nozzle, and wherein the blow-off device is configured to provide a stream of fluid to the nozzle.

20. The maintenance apparatus of claim 19, wherein one or more of the first member and second member comprise a passage fluidly coupling the nozzle to the blow-off device.

* * * * *